US007412196B2

(12) United States Patent
Chen

(10) Patent No.: US 7,412,196 B2
(45) Date of Patent: Aug. 12, 2008

(54) FUSER WITH A SUBSTANTIALLY U-SHAPED REFLECTIVE HOOD FOR A LASER PRINTER

(75) Inventor: Yi-Chieh Chen, Taichung County (TW)

(73) Assignee: Lite-On Technology Corporation, Taipei (TW)

( * ) Notice: Subject to any disclaimer, the term of this patent is extended or adjusted under 35 U.S.C. 154(b) by 396 days.

(21) Appl. No.: 11/259,427

(22) Filed: Oct. 25, 2005

(65) Prior Publication Data

US 2007/0041759 A1 Feb. 22, 2007

(30) Foreign Application Priority Data

Aug. 16, 2005 (TW) ..... 94127908 A

(51) Int. Cl.
*G03G 15/20* (2006.01)

(52) U.S. Cl. ..... 399/328; 399/336

(58) Field of Classification Search ..... 399/328, 399/336

See application file for complete search history.

(56) References Cited

U.S. PATENT DOCUMENTS 4,714,427 A * 12/1987 Tsuruoka et al. ..... 219/216
5,933,695 A 8/1999 Henry et al.
6,649,874 B2 11/2003 Eskey
6,674,990 B2 1/2004 Rohde et al.

FOREIGN PATENT DOCUMENTS

JP 07152271 A * 6/1995

* cited by examiner

*Primary Examiner*—David M. Gray
*Assistant Examiner*—Ryan D Walsh
(74) *Attorney, Agent, or Firm*—Quintero Law Office

(57) ABSTRACT

A fuser for a laser printer. A heating lamp is disposed in a reflective hood. A heating roller is disposed under the heating lamp and adjacent to the reflective hood. The heating roller is separated from the heating lamp by a predetermined distance. An axial axis of the heating roller is parallel to that of the heating lamp. A pressurization roller is disposed under and rotatably abuts the heating roller. An axial axis of the pressurization roller is parallel to that of the heating roller.

6 Claims, 5 Drawing Sheets

FUSER WITH A SUBSTANTIALLY U-SHAPED REFLECTIVE HOOD FOR A LASER PRINTER

BACKGROUND

The invention relates to a fuser, and in particular to a fuser for a laser printer.

Generally, a conventional laser printer bonds toner (carbon powder) to print media sheets using heating and pressure. A heat source of the conventional laser printer may comprise a halogen lamp or a ceramic heater.

Referring to FIG. 1, after a media sheet P enters a conventional laser printer 1, a laser scan unit (LSU) 11 projects laser light carrying image data to a sensitization roller 12. Carbon powder in a toner cartridge 13 is fixed to an imaging area on the sensitization roller 12 by operation of a roller 14. The rotating sensitization roller 12 continuously applies the carbon powder having the image data to the media sheet P. The media sheet P then passes through a fuser 15 and the carbon powder thereon is securely bonded to the media sheet P thereby.

Referring to FIG. 2, the fuser 15 comprises a hollow heating roller 16, a pressurization roller 17, and a halogen lamp 18. The halogen lamp 18 is disposed in the hollow heating roller 16, and the pressurization roller 17 rotatably contacts the hollow heating roller 16. When the carbon powder is bonded to the paper sheet P by the fuser 15, the halogen lamp 18 generates and outputs heat to a peripheral surface of the hollow heating roller 16 by thermal radiation. By rotation of the hollow heating roller 16 and pressurization roller 17, heating of the hollow heating roller 16, and pressurization of the pressurization roller 17, the carbon powder is continuously and securely bonded to the media sheet P.

The fuser 15, however, has many drawbacks. Transmitted to the peripheral surface of the hollow heating roller 16 by thermal radiation, heat generated by the halogen lamp 18 must be significantly increased. Moreover, as the halogen lamp 18 is disposed in the hollow heating roller 16, the hollow heating roller 16 is required to have a predetermined size. Namely, the hollow heating roller 16 has a large peripheral surface area. At this point, time required to transmit the heat from the halogen lamp 18 to the peripheral surface of the hollow heating roller 16 is increased. Accordingly, preheating time required by the fuser 15 is increased, causing increased electrical consumption of the laser printer 1 and inconvenience. Additionally, as the fuser 15 is not provided with any effective thermal insulation, much heat is dissipated into the laser printer 1 from the peripheral surface of the hollow heating roller 16, reducing the efficiency of thermal utilization of the halogen lamp 18 and increasing the temperature of other elements. Thus, the laser printer 1 is easily damaged.

Additionally, conventional fusers may use a ceramic heater rather than a halogen lamp. The ceramic heater, however, is very expensive. Moreover, the inner structure of the fuser disposed with the ceramic heater is complicated.

SUMMARY

Accordingly, an exemplary embodiment of the invention provides a fuser for a laser printer, comprising a reflective hood, a heating lamp, a heating roller, and a pressurization roller. The heating lamp is disposed in the reflective hood. The heating roller is disposed under the heating lamp and adjacent to the reflective hood. The heating roller is separated from the heating lamp by a predetermined distance. An axial axis of the heating roller is parallel to that of the heating lamp. The pressurization roller is disposed under and rotatably abuts the heating roller. An axial axis of the pressurization roller is parallel to that of the heating roller.

The reflective hood comprises a substantially U-shaped cross section comprising a curved portion, two linear portions, and an opening. The linear portions are respectively connected to two ends of the curved portion. The opening is between the linear portions and opposite the curved portion. The heating roller is disposed in the opening. The heating lamp is disposed between the curved portion and the opening.

The width of the opening equals the diameter of the heating roller.

The fuser further comprises a thermal insulation layer covering the outer surface of the reflective hood.

The heating lamp comprises a halogen lamp.

DESCRIPTION OF THE DRAWINGS

The invention can be more fully understood by reading the subsequent detailed description and examples with references made to the accompanying drawings, wherein.

DETAILED DESCRIPTION

Figure 1:
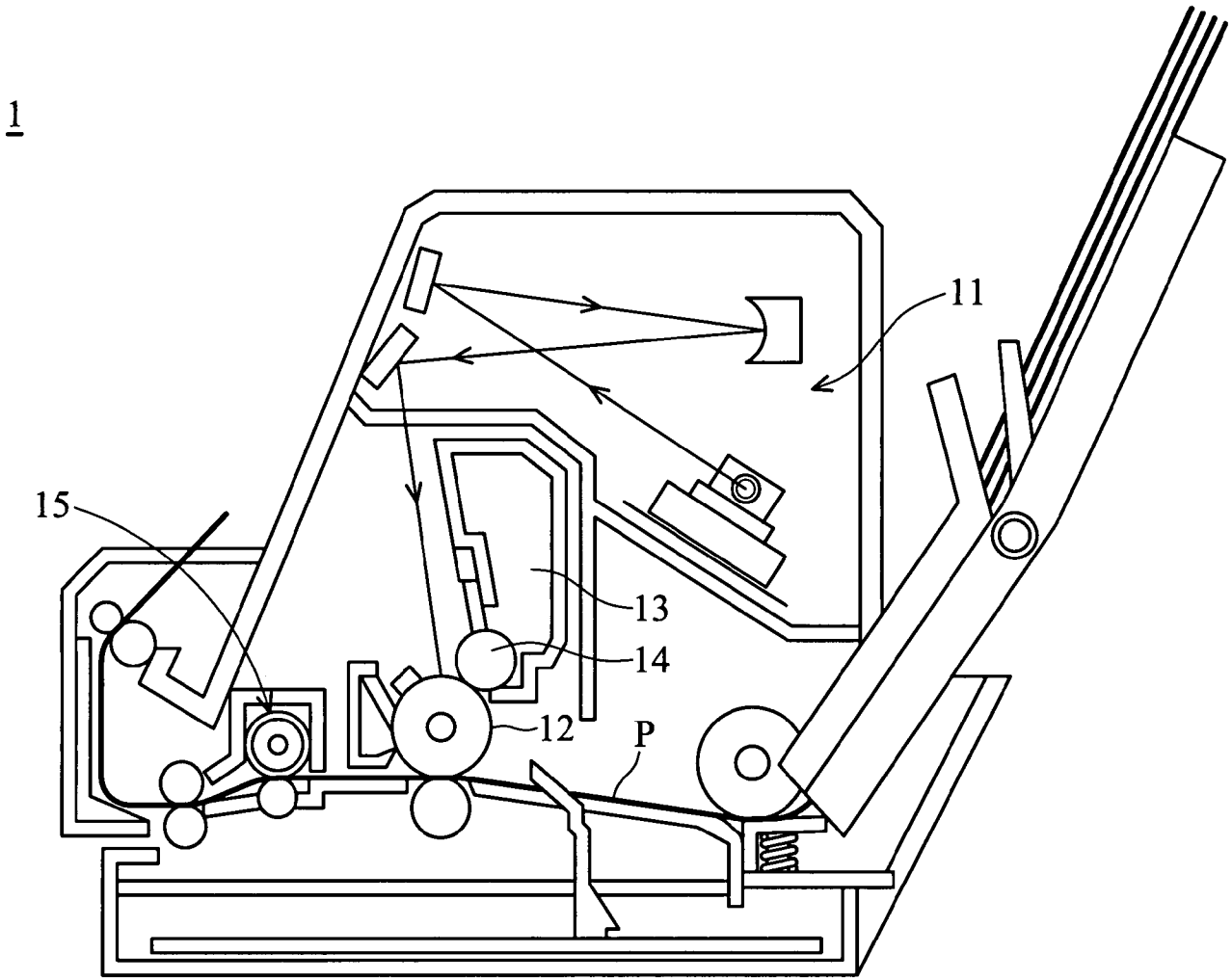
FIG. 1 ( RELATED ART )
FIG. 1 is a schematic view of a conventional laser printer.
Figure 2:
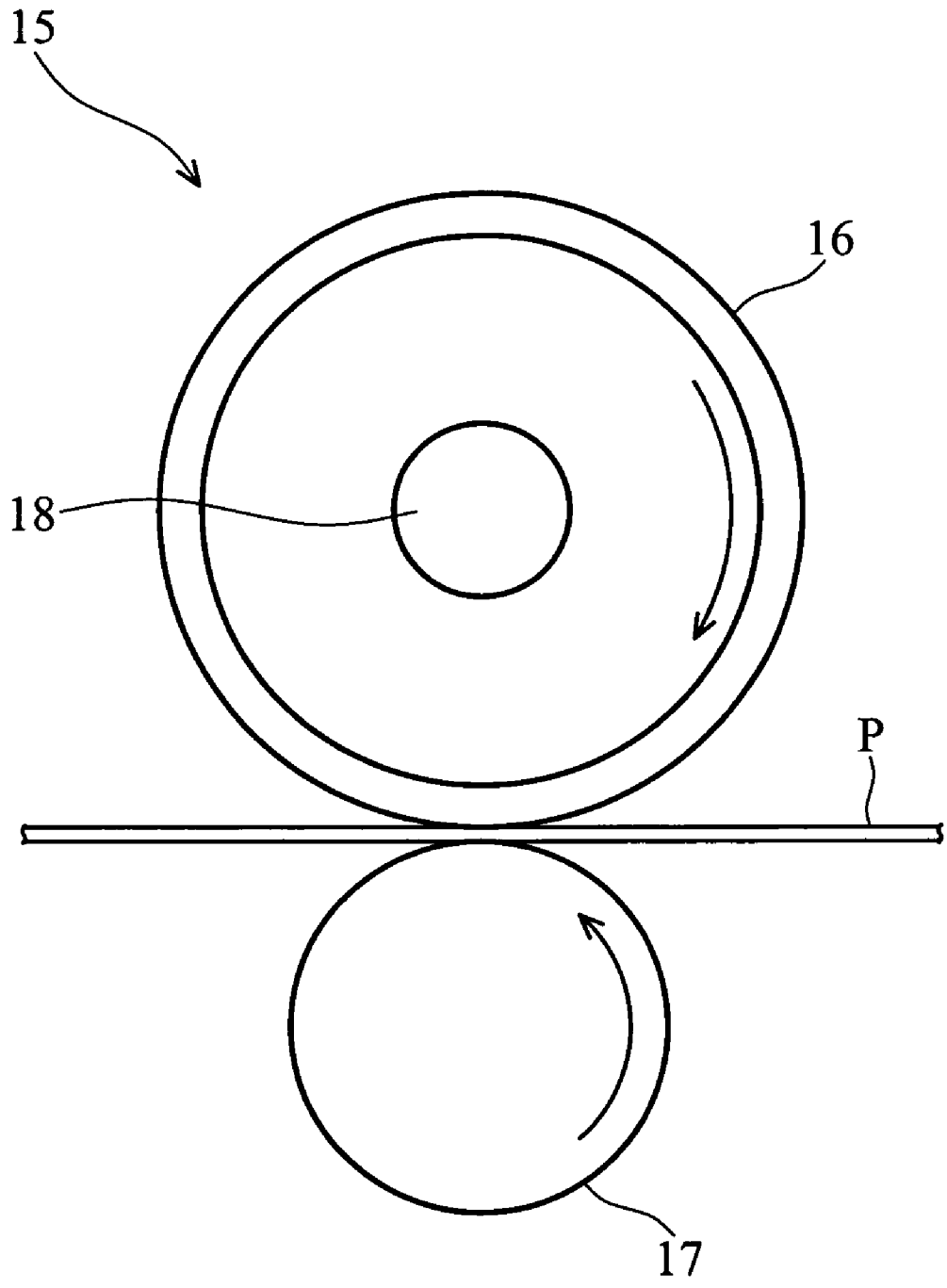
FIG. 2 ( RELATED ART )
FIG. 2 is a schematic front view of a conventional fuser of FIG. 1.
Figure 3:
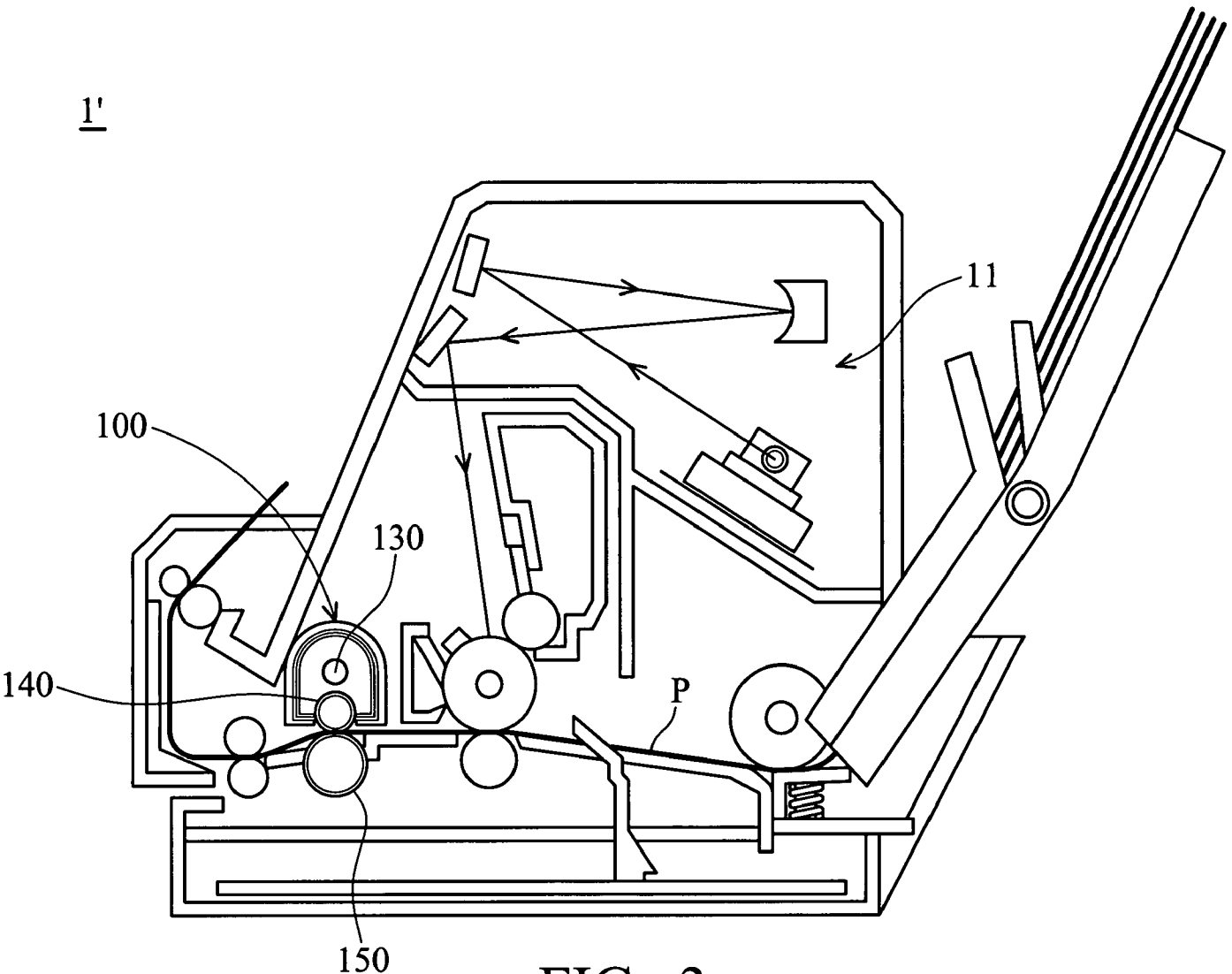
FIG. 3 is a schematic view of a laser printer employing a fuser of an embodiment of the invention.

Referring to FIG. 3, the fuser 100 is applied in a laser printer 1'.

Figure 4:
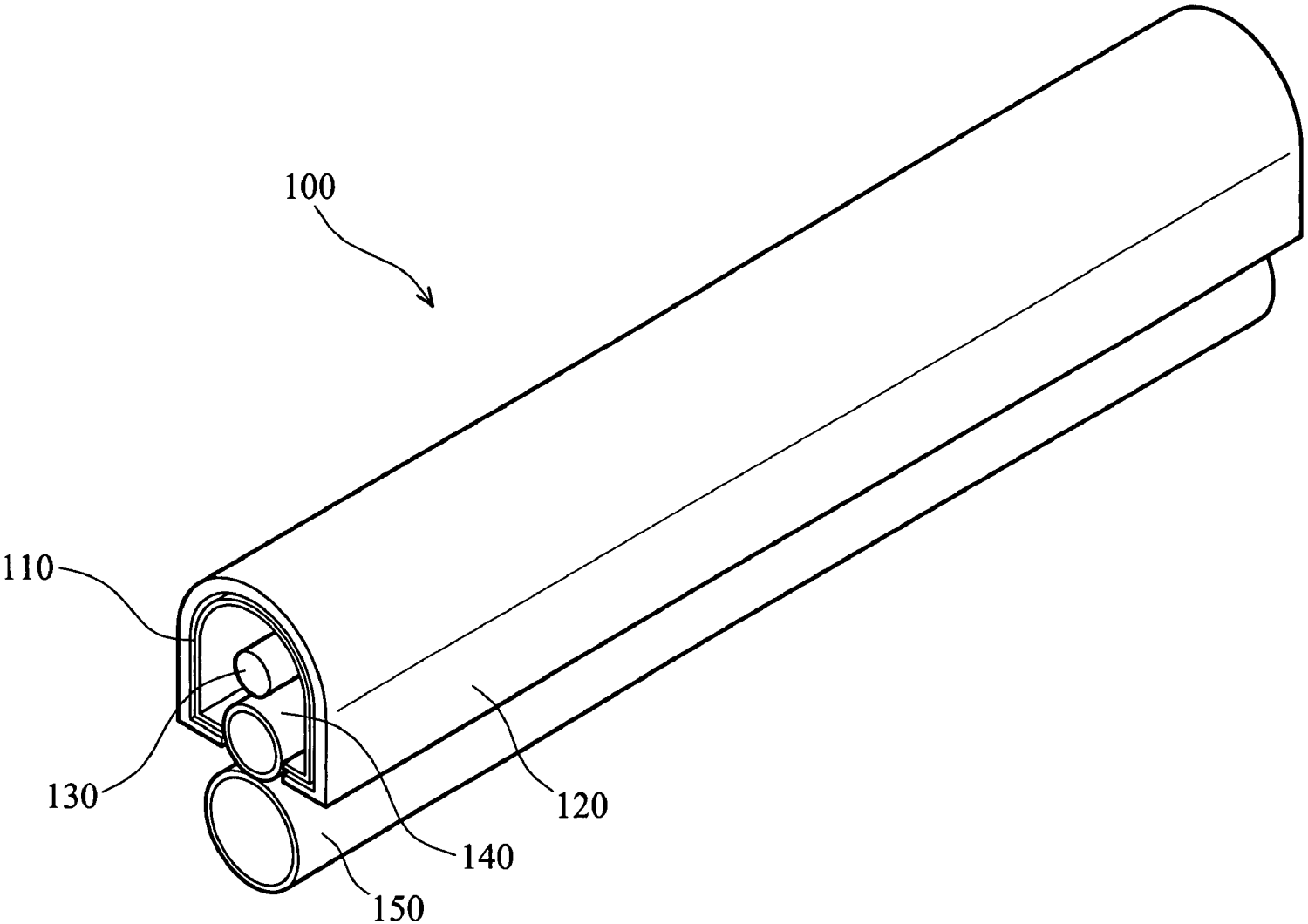
FIG. 4 is a schematic perspective view of a fuser of an embodiment of the invention.
Figure 5:
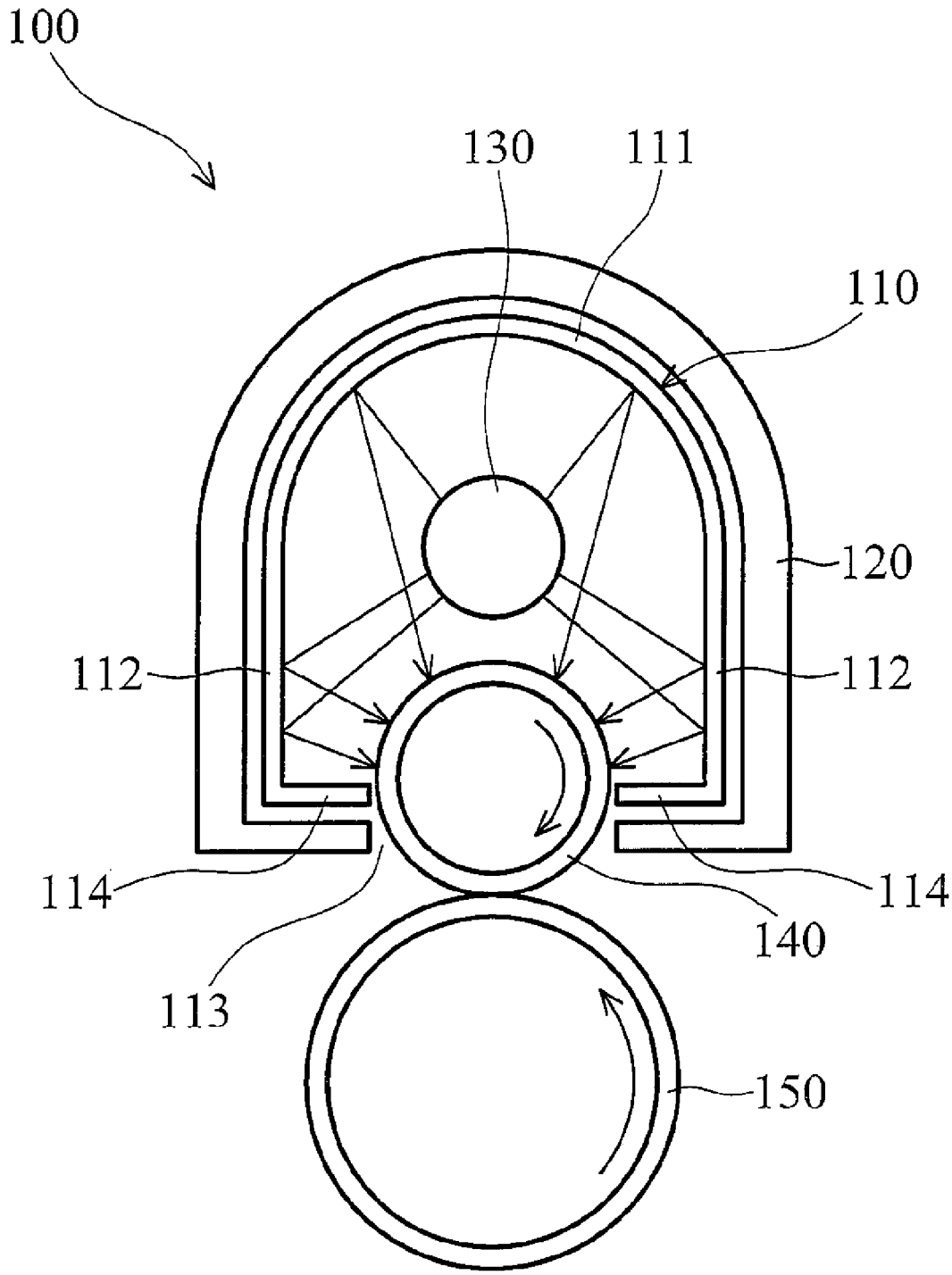
FIG. 5 is a schematic front view of a fuser of an embodiment of the invention.

Referring to FIG. 4 and FIG. 5, the fuser 100 comprises a reflective hood 110, a thermal insulation layer 120, a heating lamp 130, a heating roller 140, and a pressurization roller 150.

Specifically, the reflective hood 110 comprises a curved portion 111, two first linear portions 112, two second linear portions 114, and an opening 113. The first linear portions 112 are respectively connected to two ends of the curved portion 111. Each first linear portion 112 is connected between the curved portion 111 and each second linear portion 114 and is perpendicular to each second linear portion 114. The opening 113 is between the second linear portions 114 and opposite the curved portion 111.

The heating lamp 130 is disposed in the reflective hood 110 and between the curved portion 111 and the opening 113. In this embodiment, the heating lamp 130 may be a halogen lamp.

The heating roller 140 is disposed under the heating lamp 130 and adjacent to the reflective hood 110. Specifically, the heating roller 140 is disposed in the opening 113 and is separated from the heating lamp 130 by a predetermined distance. Additionally, an axial axis of the heating roller 140 is parallel to that of the heating lamp 130. In this embodiment, the width of the opening 113 is substantially equal to the diameter of the heating roller 140, such that the reflective hood 110 and heating roller 140 form a substantially closed structure.

The pressurization roller 150 is disposed under and rotatably abuts the heating roller 140. Additionally, an axial axis of the pressurization roller 150 is parallel to that of the heating roller 140.

The thermal insulation layer 120 covers the outer surface of the reflective hood 110 and comprises material having a high thermal resistance.

As shown in FIG. 3, when a media sheet P with carbon powder thereon passes through an area between the heating roller 140 and the pressurization roller 150 of the fuser 100, the carbon powder is securely bonded to the media sheet P by rotation of the heating roller 140 and pressurization roller 150, heating of the heating roller 140, and pressurization of the pressurization roller 150.

Accordingly, when the fuser 100 operates, the heating lamp 130 generates heat. The heat generated by the heating lamp 130 is transmitted to the heating roller 140 directly and through reflection of the reflective hood 110 by thermal radiation. Thus, the heat generated by the heating lamp 130 is rapidly absorbed by the heating roller 140. Moreover, as the reflective hood 110 is covered by the thermal insulation layer 120, minimal heat is dissipated to the exterior of the reflective hood 110. The efficiency of thermal utilization of the heating lamp 130 is significantly enhanced, thus reducing preheating time required by the fuser 100 and electrical consumption of the laser printer 1' and preventing overheating of other elements in the laser printer 1'. Specifically, although the heating lamp 130 is disposed between the curved portion 111 and the opening 113, the disposed position of the heating lamp 130 can be adjusted to enhance the efficiency of reflection of the reflective hood 110. Moreover, to enhance the heating efficiency of the heating roller 140, the size thereof can be reduced. For example, the diameter of the heating roller 140 may be equal to or even less than that of the heating lamp 130. The peripheral surface area of the heating roller 140 can be greatly reduced and, thereby, time required to heat the heating roller 140 to a predetermined temperature. Furthermore, as the heating efficiency of the heating roller 140 is enhanced, heat generated by the heating lamp 130 can be correspondingly reduced, thereby reducing total electrical consumption of the laser printer 1'.

While the invention has been described by way of examples and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A fuser for a laser printer, comprising:

a reflective hood comprising a substantially U-shaped cross section comprising a curved portion, two first linear portions, two second linear portions, and an opening, wherein the first linear portions are respectively connected to two ends of the curved portion, each first linear portion is connected between the curved portion and each second linear portion and is perpendicular to each second linear portion, and the opening is between the second linear portions and opposite the curved portion;

a heating lamp disposed in the reflective hood;

a heating roller disposed under the heating lamp and adjacent to the reflective hood, wherein the heating roller is separated from the heating lamp by a predetermined distance, and an axial axis of the heating roller is parallel to that of the heating lamp; and a pressurization roller disposed under and rotatably abutting the heating roller, wherein an axial axis of the pressurization roller is parallel to that of the heating roller.

2. The fuser as claimed in claim 1, wherein the heating roller is disposed in the opening, and the heating lamp is disposed between the curved portion and the opening.

3. The fuser as claimed in claim 2, wherein the width of the opening equals the diameter of the heating roller.

4. The fuser as claimed in claim 1, further comprising a thermal insulation layer covering the outer surface of the reflective hood.

5. The fuser as claimed in claim 1, wherein the heating lamp comprises a halogen lamp.

6. The fuser as claimed in claim 1, wherein the diameter of the heating roller is equal to or less than that of the heating lamp.

* * * * *